US006207625B1

(12) United States Patent
Ogano et al.

(10) Patent No.: US 6,207,625 B1
(45) Date of Patent: Mar. 27, 2001

(54) LUBRICANT OIL COMPOSITION FOR DIESEL ENGINES (LAW913)

(75) Inventors: Satoshi Ogano, Fujimi; Toshiaki Kuribayashi, Tsurugashima, both of (JP)

(73) Assignee: Tonen Corporation, Saitama (JP)

( * ) Notice: Subject to any disclaimer, the term of this patent is extended or adjusted under 35 U.S.C. 154(b) by 0 days.

(21) Appl. No.: 09/459,031

(22) Filed: Dec. 10, 1999

(30) Foreign Application Priority Data

Dec. 21, 1998 (JP) ..... 10-362440

(51) Int. Cl.[7] ..... C10M 141/06
(52) U.S. Cl. ..... 508/365; 508/376
(58) Field of Search ..... 508/365, 376

(56) References Cited

U.S. PATENT DOCUMENTS

| | | | | |
|---|---|---|---|---|
| 4,178,258 | | 12/1979 | Papay et al. | 252/32.7 E |
| 4,395,343 | * | 7/1983 | deVries et al. | 508/365 |
| 4,402,840 | * | 9/1983 | deVries | 508/365 |
| 4,529,526 | | 7/1985 | Inoue et al. | 252/32.7 E |
| 5,356,547 | | 10/1994 | Arai et al. | 252/46.4 |
| 5,627,146 | * | 5/1997 | Tanaka et al. | 508/363 |
| 5,672,572 | | 9/1997 | Arai et al. | 508/364 |
| 5,688,748 | | 11/1997 | Tomizawa | 508/363 |
| 5,707,942 | | 1/1998 | Arai et al. | 508/365 |
| 5,744,430 | | 4/1998 | Inoue et al. | 508/295 |
| 5,858,931 | * | 1/1999 | Tanaka et al. | 508/364 |
| 5,861,363 | * | 1/1999 | Willis, Jr. et al. | 508/192 |

FOREIGN PATENT DOCUMENTS

| | | | |
|---|---|---|---|
| 0304011 | 2/1989 | (EP) | C10M/137/10 |
| 0699739 | 3/1996 | (EP) | C10M/141/10 |
| 54-103404 | 8/1979 | (JP) | C10M/01/48 |
| 54-113604 | 9/1979 | (JP) | C10M/01/54 |
| 5-230485 | 7/1993 | (JP) | C10M/163/00 |
| 7-207290 | 8/1995 | (JP) | C10M/163/00 |

* cited by examiner

*Primary Examiner*—Jacqueline V. Howard
(74) *Attorney, Agent, or Firm*—Joseph J. Allocca

(57) ABSTRACT

The present invention relates to a lubricant oil composition, comprising a base oil composed of a mineral and/or synthetic oil incorporated with at least two types of additives (A) and (B) described below, characterized by being used for diesel engines operating with large quantities of soot in their oil, in particular those equipped with an exhaust gas recirculation (EGR) system: (A) sulfurized oxymolybdenum dithiocarbamate at 0.03 to 0.50 wt % as Mo, based on the whole composition, and (B) zinc dialkyl dithiophosphate at 0.04 to 0.50 wt % as P, also based on the whole composition.

3 Claims, No Drawings

LUBRICANT OIL COMPOSITION FOR DIESEL ENGINES (LAW913)

BACKGROUND OF THE INVENTION

1. Field of the Invention

This invention relates to a lubricant oil composition, more particularly a composition efficiently preventing wear of diesel engines operating with large quantities of soot in their oil, and particularly suitable for diesel engines equipped with an exhaust gas recirculation (sometimes referred to as EGR) system.

2. Description of the Related Art

Lubricant oils have been used for internal combustion engines to lubricate internal combustion engines, devices in driving systems (e.g., automatic transmissions, shock absorbers and power steerings) and gears having sliding mechanical parts for their smooth operation. In particular, lubricant oil for combustion engines are used mainly for piston rings and cylinder liners, bearings for crank shafts and connecting rods, valve trains including cams and valve lifters, and other sliding mechanical parts. They are also used for cooling the engines, cleaning and dispersing combustion products, and prevention of rust and corrosion, in addition to the lubricating purposes. As described above, lubricant oils for internal combustion engines are required to exhibit a variety of function. These requirements are becoming even severer, as the engines become more functional produce higher power and are operated under severer conditions. The essential functions of a lubricant oil for internal combustion engines are to prevent wear and seizure by helping the engine operate smoothly under all conditions. Hydrodynamic lubrication prevails in an engine, but boundary lubrication may occur in some sections, e.g., valve trains and dead centers in the cylinders. In general, zinc dithiophosphate or the like is added to prevent wear in the boundary lubrication areas.

Recently, lubricant oils for internal combustion engines are required to have extended intervals between oil exchanging, to abate release of spent oils for environmental considerations. Association of European Automobile Manufacturers (ACEA) has already established the specifications involving extended intervals between oil exchanging for lubricant oils for internal combustion engines. The extended period is required also in Japan.

Air pollution by diesel engine exhaust gases, in particular by NOx, is becoming more acute worldwide. Therefore, many governments are strengthening restrictions on $NO_x$ and particulate matter exhausted from diesel engines, to abate these emissions. It is considered that the engine makers will have to equip diesel engines with an EGR system, which is already adopted for gasoline engines, to clear these restrictions which are becoming more and more stringent. An EGR system to abate $NO_x$ emissions will increase particulate matter emissions. It will increase soot in the diesel engine oil, which accelerates wear of the valve trains and pistons/cylinders, making it more difficult to extend service intervals. Improved engine combustion to abate particulate matter emissions leads to increased temperature at the piston, which accelerates deterioration of the lubricant by oxidation, increasing load on the oil.

The techniques to prevent wear of valve trans and pistons/cylinders by soot in the lubricant have failed to drastically extend oil service intervals in the midst of increased load on the oil.

A variety of techniques have been proposed to reduce wear of internal combustion engines; e.g., use of four types of additives including zinc dithiophosphate (Japanese Laid-open Patent Application No. 54-103404), combination of an organomolybdenum compound and zinc dithiophosphate (Japanese Laid-open Patent Application No. 54-113604), and combination of an organomolybdenum compound, salicylate and bis type succinimide (Japanese Laid-open Patent Application No. 5-230485). The techniques aimed at extended service interval of lubricant include a combination of an organomolybdenum compound, zinc dithiophosphate and polysulfide (Japanese Laid-open Patent Application No. 8-73878).

Unlike a gasoline engine, a diesel engine tends to suffer contamination of the engine oil with large quantities of soot produced as a result of incomplete combustion of diesel fuel, as described earlier. It is considered that the soot, having surface activity, adsorbs a polar additive present in the oil and scrapes off a film formed on a friction plane.

The conventional techniques to incorporate antiwear agents, such as zinc dithiophosphate, may not sufficiently prevent wear of diesel engines under severe friction/wear conditions in which the lubricant oil is contaminated with soot, the conditions much different from those associated with gasoline engines. As one of few techniques proposed so far to improve ability of diesel engines to prevent wear, a combination of molybdenum alkyl dithiophosphate (Mo concentration: 200 to 400 ppm), zinc primary alkyl dithiophosphate and salicylate is disclosed by Japanese Laid-open Patent Application No. 7-207290.

These techniques, however, fail to exhibit sufficient effects of preventing wear of diesel engines equipped with an EGR system, which provide lubricating conditions with large quantities of soot present in the engine oil. Therefore, the techniques to develop lubricant oil compositions for diesel engines which can prevent soot-induced wear of sliding members, e.g., valve trains and pistons/cylinders, have been strongly demanded.

DESCRIPTION OF THE INVENTION

The present invention relates to a lubricant oil composition which shows excellent effect of preventing wear of diesel engines operating with large quantities of soot in their oil, and is particularly suitable for diesel engines equipped with an exhaust gas recirculation system.

The lubricant oil composition shows a surprisingly high function of preventing wear of the engine parts under lubricating conditions with soot, when incorporated with specific quantities of a specific organomolybdenum compound and zinc dialkyl dithiophosphate.

The present invention provides a lubricant oil composition comprising a base oil composed of a mineral and/or synthetic oil incorporated with at least two types of additives (A) and (B) described below, characterized by being used for diesel engines operating with large quantities of soot in their oil: (A): sulfurized oxymolybdenum dithiocarbamate at 0.03 to 0.50 wt % as Mo, based on the whole composition, and (B): zinc dialkyl dithiophosphate at 0.04 to 0.50 wt % as P, also based on the whole composition.

The present invention also provides a lubricant oil composition which is used for diesel engines equipped with an exhaust gas recirculation (EGR) system.

As described above, the present invention provides a lubricant oil composition which is incorporated with specific quantities of a specific organomolybdenum compound and zinc dialkyl dithiophosphate for diesel engines operating with large quantities of soot in their oil, in particular diesel engines equipped with an EGR system. The preferred embodiments of the present invention include:

(1) the lubricant oil composition above described which is incorporated with sulfurized oxymolybdenum dithiocarbamate at 0.04 to 0.20 wt % (400 to 2,000 ppm) as Mo,
(2) the lubricant oil composition of one of the above described ones which is incorporated with a zinc dialkyl dithiophosphate at 0.07 to 0.20 wt % (700 to 2,000 ppm) as P,
(3) the lubricant oil composition of one of the above described ones which is used for diesel engines operating with soot present in the lubricant oil at about 0.2 to 10 wt %, and
(4) the lubricant oil composition of one of the above described ones, wherein the alkyl group in the zinc dialkyl dithiophosphate is a mixture of primary and secondary alkyl groups.

The Present Invention is Described in Detail, Below.

1. Lubricant Base Oil

The base oil for the lubricant oil composition of the present invention is not limited, and any one which is normally used as a lubricant base oil can be also used for the present invention. In other words, it may be a mineral oil, synthetic oil or a mixture thereof.

The mineral oils useful for the present invention include lubricant stocks, obtained by atmospheric or vacuum distillation of a crude, which are treated by various processes; e.g., raffinate from solvent extraction with an aromatic extractant such as phenol furfural or N-methyl pyrrolidone; hydrotreated oil obtained by treating stocks with hydrogen under hydrotreatment conditions in the presence of a hydrotreatment catalyst; isomerate obtained by isomerizing wax with hydrogen under isomerization conditions in the presence of an isomerization catalyst; and those stocks obtained by a combination of solvent refining, hydrotreatment or isomerization. Any process described above can be optionally combined with dewaxing, hydrofinishing, clay treatment or the like operated in a normal manner. More specifically, the mineral oils useful for the present invention include light, medium and heavy neutral oils, and bright stocks. These base oils can be mixed with one another, to satisfy the requirements of the present invention.

The examples of synthetic base oils useful for the present invention include poly-α-olefin, α-olefin oligomer, polybutene, alkylbenzene, polyol ester, dibasic acid ester, polyoxyalkylene glycol, polyoxyalkylene glycol ether, and silicone oil etc.

These base oils may be used individually or in combination. A mineral oil may be combined with a synthetic oil. The base oil for the present invention generally has a kinematic viscosity of 2 to 20 $mm^2/s$ at 100° C., preferably 3 to 15 $mm^2/s$. Viscosity beyond the above range causes problems, e.g., excessively increased agitation resistance or coefficient of friction in the film lubrication region to deteriorate fuel-saving characteristics when it exceeds the above range, and increased wear at sliding members, e.g., valve trains, pistons, rings and bearings of diesel engines when it is below the above range.

2. Sulfurized Oxymolybdenum Dithiocarbamate

Sulfurized oxymolybdenum dithiocarbamate (MoDTC) as the essential component for the lubricant oil composition of the present invention is represented by the general formula [1]:

[1]

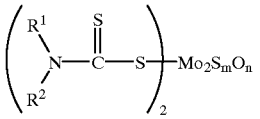

wherein, $R^1$ and $R^2$ are each a hydrocarbon group having a carbon number of 4 to 18, identical or different, and (m) and (n) are each a positive integer and (m)+(n)=4. The hydrocarbon groups having a carbon number of 4 to 18 in the general formula [1] include an alkyl group having a carbon number of 4 to 18; alkenyl group having a carbon number of 4 to 18; cycloalkyl group having a carbon number of 4 to 18; and aryl, alkylaryl and arylalkyl groups having a carbon number of 6 to 18. The alkyl and alkenyl groups may be of straight-chain or branched. The hydrocarbon groups of $R^1$ or $R^2$ preferably have a carbon number of 4 to 13. The concrete examples of the hydrocarbon groups of $R^1$ or $R^2$ include butyl pentyl, hexyl, heptyl, 2-ethylhexyl octyl, nonyl, decyl, undecyl dodecyl, tridecyl, octenyl, nonenyl, decenyl, undecenyl, dodecenyl, tridecenyl, tetradecenyl, hexadecenyl, octadecenyl, dimethylcyclohexyl, ethylcyclohexyl, methylcyclohexyl, cyclohexylethyl propylcyclohexyl, butylcyclohexyl, heptylcyclohexyl, dimethylphenyl, methylbenzyl, phenetyl, naphthyl and dimethylnaphthyl groups. One or more types of sulfurized oxymolybdenum dithiocarbamate may be used for the present invention. The sulfurized oxymolybdenum dithiocarbamate is incorporated at 0.03 to 0.50 wt % (300 to 5,000 ppm) as molybdenum (Mo) derived from the sulfurized oxymolybdenum dithiocarbamate, based on the whole lubricant composition, preferably 0.04 to 0.20 wt % (400 to 2,000 ppm). At below 0.03 wt %, its wear preventing effect may not be sufficiently exhibited. On the other hand, increasing its content beyond 0.50 wt % may not increase its wear preventing effect as expected from the increased content, and may conversely cause problems, such as accelerated formation of sludge.

3. Zinc Dialkyl Dithiophosphate

Zinc dialkyl dithiophosphate (ZnDTP) as the essential component for the lubricant oil composition of the present invention is represented by the general formula [2]:

[2]

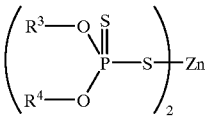

wherein, $R^3$ and $R^4$ are each a primary or secondary alkyl group having a carbon number of 1 to 18, identical or different. The primary or secondary alkyl groups of $R^3$ or $R^4$ include methyl, ethyl, propyl, butyl, pentyl, hexyl, heptyl, 2-ethylhexyl octyl, nonyl, decyl, undecyl dodecyl, tridecyl tetradecyl, pentadecyl, hexadecyl heptadecyl and octadecyl. It is preferable to use a zinc dialkyl dithiophosphate having a mixed alkyl group of primary and secondary alkyl groups having a carbon number of 3 to 12. A primary alkyl group, higher in thermal and oxidation stability, is mixed with a secondary alkyl group to help prevent wear of the sliding members, e.g., valve trains, which tends to be accelerated in the presence of soot in the oil in particular in a diesel engine equipped with an EGR system. One or more types of zinc dialkyl dithiophosphates having a mixed alkyl group of primary and secondary alkyl groups may be used for the lubricant oil composition of the present invention. The zinc dialkyl dithiophosphate is incorporated at 0.04 to 0.50 wt % as P derived from the zinc dialkyl dithiophosphate, based on the whole composition, preferably 0.07 to 0.20 wt %. At below 0.04 wt %, its wear preventing effect may be insufficient under the lubricating condition with soot present in the oil. On the other hand, increasing its content beyond 0.50 wt % may not increase its wear preventing effect as expected from the increased content.

In accordance with teaching of the present invention, a lubricant oil composition may not fully exhibit the effect of preventing wear of sliding members, e.g., valve trains, under the lubricating condition with soot in the oil, unless its base oil is incorporated with specific quantities of the above-described sulfurized oxymolybdenum dithiocarbamate and zinc dialkyl dithiophosphate.

The theory that explains the effect of preventing wear under the lubricating condition with soot in the oil in the simultaneous presence of the sulfurized oxymolybdenum dithiocarbamate and zinc dialkyl dithiophosphate is not fully substantiated. However, it is considered that the zinc dialkyl dithiophosphate as an antiwear agent exhibits its function after being adsorbed on the metal surface to form an inorganic extreme pressure film containing sulfur, phosphorus and zinc. At the same time, the sulfurized oxymolybdenum dithiocarbamate as a friction-reducing agent works to reduce friction and wear after being thermally decomposed on the friction surface to form molybdenum disulfide in the interface. Formation of the extreme pressure film by the zinc dialkyl dithiophosphate competes with formation of molybdenum disulfide in the interface by the sulfurized oxymolybdenum dithiocarbamate, allowing them to coexist. In a diesel engine, in particular that equipped with an EGR system, the engine oil is contaminated with large quantities of soot, as described earlier. The soot works to scrape the film off the friction surface on which it is formed. This phenomenon proceeds faster than formation of the extreme pressure film of the zinc dialkyl dithiophosphate in the absence of the sulfurized oxymolybdenum dithiocarbamate, with the result that the film can no longer exhibit its wear-preventing function. Similarly, it proceeds faster than formation of the film formed on the friction surface with soot by sulfurized oxymolybdenum dithiocarbamate in the absence of zinc dialkyl dithiophosphate, with the result that molybdenum disulfide formed can no longer exhibit its friction-reducing and wear-preventing functions. Surprisingly, in the simultaneous presence of these compounds, it is considered that the soot selectively scrapes molybdenum disulfide formed on the friction surface by the sulfurized oxymolybdenum dithiocarbamate, but has little effect on the extreme pressure film of the zinc dialkyl dithiophosphate. This concept is supported by the observation that, in the simultaneous presence of these compounds, their friction-reducing effects work in a concerted manner in the presence of soot, whereas the wear-preventing function is not affected much whether soot is present or not.

The lubricant oil composition of the present invention is used for a diesel engine operating with large quantities of soot in its oil. Quantity of soot in the oil is within a range from 0.2 to 10.0 wt %, preferably from 0.5 to 10.0 wt %. Concentration of the soot in oil described in this specification, is n-hexane insolubles determined by the supercentrifugal separation method affected under the conditions of centrifugal force: 36,790 G, rotational speed: 17,500 rpm, time: 30 minutes, number of times: 3, and temperature: 0° C.

4. Other Additive Components

The lubricant oil composition of the present invention comprises a base oil incorporated with specific quantities of the sulfurized oxymolybdenum dithiocarbamate and zinc dialkyl dithiophosphate as the essential components. A lubricant oil for diesel engines are required to have a variety of functions, and in order to satisfy specific requirements, the base oil for the present invention may be incorporated with one or more types of other additives, so long as the object of the present invention is not damaged. These additives include viscosity index improver, pour point depressant, ashless dispersant, metallic detergent, antioxidant, friction reducing agent, antiwear agent, extreme pressure agent, metal deactivator, rust inhibitor, antifoaming agent, corrosion inhibitor and coloring agent.

The viscosity index improvers useful for the present invention generally include polymethacrylate-based, olefin copolymer-based (e.g., isobutylene-based and ethylene-propylene copolymer-based), polyalkyl styrene-based, hydrogenated styrene-butadiene copolymer-based, and styrene-maleic anhydride ester copolymer-based VI improver. If present, it is incorporated at 1 to 30 wt %.

The pour point depressants useful for the present invention include ethylene-vinyl acetate copolymer, condensate of chlorinated paraffin and naphthalene, condensate of chlorinated paraffin and phenol, polymethacrylate, and polyalkyl styrene. Of these, a polymethacrylate is preferably used. If present, it is incorporated at 0.01 to 5 wt %.

The ashless dispersants useful for the present invention include those based on polyalkenyl succinimide, polyalkenyl succinamide, benzyl amine, succinic acid ester, and succinic acid-amide, and those containing boron. Of these, a polyalkenyl succinimide (polybutenyl succinimide)-based one is preferably used. If present, it is incorporated at 0.1 to 15 wt %.

The metallic detergents useful for the present invention include those based on sulfonate, phenate, salicylate and phosphonate of Ca, Mg, Ba, Na or the like. If present, it is incorporated at 0.05 to 5 wt %.

The antioxidants useful for the present invention include amine-based ones, e.g., alkylated diphenyl amine, phenyl-α-naphthyl amine and alkylated phenyl-α-naphthyl amine; phenol-based ones, e.g., 2,6-ditertiary butyl phenol and 4,4'-methylene bis-(2,6-ditertiary butyl phenol); sulfur-based ones, e.g., dilauryl-3,3'-thiodipropionate; phosphorus-based ones, e.g., phosphite; and zinc dithiophosphate. Of these, amine-based and phenol-based ones are preferably used. If present, it is incorporated at 0.05 to 5 wt %.

The friction reducing agents useful for the present invention include a fatty acid, higher alcohol, partial ester with polyalcohol, fatty acid ester, oil and fat, amine, amide, sulfurized ester, phosphate ester, phosphite ester and phosphate ester amine, in addition to the sulfurized oxymolybdenum dithiocarbamate as the essential component for the present invention. If present, it is incorporated at 0.05 to 3 wt %.

The antiwear agents useful for the present invention include metallic (e.g., Pb, Sb and Mo) salts of dithiophosphate, metallic (e.g., Zn, Pb, Sb and Mo) salts of dithiocarbamic acid, metallic (e.g., Pb) salts of naphthenic acid, metallic (e.g., Pb) salts of fatty acids, a boron compound, phosphate ester, phosphite ester and phosphate ester amine, in addition to the zinc as the essential component for the present invention. If present, it is incorporated at 0.1 to 5 wt %.

The extreme pressure agents useful for the present invention generally include an ashless-based sulfide compound, sulfurized oil and fat, phosphate ester, phosphite acid ester and phosphate ester amine. If present, it is incorporated at 0.05 to 3 wt %.

The metal deactivators useful for the present invention include benzotriazole, and derivatives of triazole, benzotriazole and thiadiazole. If present, it is incorporated at 0.001 to 3 wt %.

The rust inhibitors useful for the present invention include a fatty acid, alkenyl succinic acid half ester, fatty acid soap, alkyl sulfonate, ester of a fatty acid and polyalcohol fatty acid amine, oxidized paraffin and alkyl polyoxyethylene ether. If present, it is incorporated at 0.01 to 3 wt %.

The antifoaming agents useful for the present invention include a dimethyl polysiloxane and polyacrylate. If present, it is incorporated at a very small content, e.g., around 0.002 wt %.

The lubricant oil composition of the present invention may be further incorporated, as required, with other types of additives, e.g., corrosion inhibitor and coloring agent.

EXAMPLES

The present invention is described further in detail by Examples and Comparative Examples, which by no means limit the present invention. The wear preventing functions of the compositions prepared by Examples and Comparative Examples were assessed by a reciprocating type (SRV) friction/wear tester and motoring test to determine wear of a valve train, described below.

(1) Assessment by a Reciprocating Type (SRV) Friction/wear Tester

The wear test was conducted under the following test conditions using a reciprocating type (SRV) friction/wear tester, to assess the wear preventing function of each composition by measuring wear scar diameter.

Test conditions

| | |
|---|---|
| • Test specimen (friction material) | : SUJ-2 |
| • Plate | : 24 mm in diameter, 7 mm thick |

-continued

| | |
|---|---|
| • Cylinder | : 15 mm in diameter, 22 mm long |
| • Temperature | : 80° C. |
| • Load | : 150 N |
| • Amplitude | : 1.5 mm |
| • Frequency | : 50 Hz |
| • Test period | : 30 min |

(2) Assessment by the Motoring Test to Determine Wear of a Valve Train

The motoring valve train wear test (VTW test) was conducted under the following conditions using a Japan-made OHC engine (displacement: 1,500 cc), to assess the wear preventing function of each composition by the following method.

| | |
|---|---|
| • Test engine | : OHC engine (displacement: 1,500 cc) |
| • Driver | : Motor belt |
| • Engine rotational speed | : 1,000 rpm |
| • Valve spring | : 25% load |
| • Oil temperature | : 80° C. |
| • Test period | : 100 h |
| • Assessment method | : Assessment of the wear on a pad surface by demerit ratings, best rating: 0 and worst rating: 100 |

Reference Example

A solvent-refined mineral oil (viscosity: 5.6 $mm^2/s$ at 100° C.) was used as the base oil, which was incorporated with a zinc dialkyl dithiophosphate, whose al1yl group was a mixture of primary C8 and secondary C3/C6 (primary/secondary alkyl ratio: 10/9 by weight), and sulfurized oxymolybdenum dithiocarbamate at 0.14 and 0.07 wt % (1,400 and 700 ppm) as phosphorus and molybdenum, respectively, based on the whole composition. It was also incorporated with other types of additives, i.e., a metallic detergent, ashless dispersant, viscosity index improver, pour point depressant, antioxidant and antifoaming agent, at a total content of 14.4 wt %.

Examples 1 to 3

A commercial diesel engine was operated with the base oil to collect the soot, and the concentrated soot was incorporated in the lubricant oil composition prepared by Reference Example to 2.0 wt % (Example 1), 3.0 wt % (Example 2) and 5.0 wt % (Example 3). Each composition was tested by the SRV friction/wear test to measure wear scar diameter. The compositions prepared by Reference Example and Example 2 were also tested to assess their function of preventing wear by the motoring valve train wear test. The results are given in Table 1.

Examples 4 to 8

The same base oil as used for Examples 1 to 3 was incorporated with a zinc dialkyl dithiophosphate, whose alkyl group was a mixture of primary C8 and secondary C3/C6 (primary/secondary alkyl ratio: 10/9 by weight), and sulfurized oxymolybdenum dithiocarbamate at contents shown in Table 1, where the contents are based on the whole composition. It was also incorporated, as was the case of the preceding Examples, with other types of additives, i.e., a metallic detergent, ashless dispersant, viscosity index improver, pour point depressant, antioxidant and antifoaming agent, at a total content of 14.4 wt %. A commercial diesel engine was operated with the base oil to collect the soot, and the concentrated soot was incorporated in the above lubricant oil composition to contents shown in Table 1. Each composition was tested by the SRV friction/wear test to measure wear scar diameter. The results are also given in Table 1.

Examples 14 to 16 used no zinc dialkyl dithiophosphate, and Comparative Example 17 used sulfurized oxymolybdenum dialkyl dithiophosphate as an organomolybdenum compound in place of sulfurized oxymolybdenum dithiocarbamate. Each composition was tested by the SRV friction/wear test to measure wear scar diameter, in a manner similar to that for Examples 1 to 8. The composition prepared by Comparative Example 3 was also tested to assess its function of preventing wear by the motoring valve train wear test, as was the case with Reference Example and Example

TABLE 1

| | | Reference Example | Example 1 | Example 2 | Example 3 | Example 4 | Example 5 | Example 6 | Example 7 | Example 8 |
|---|---|---|---|---|---|---|---|---|---|---|
| Base oil: Mineral oil (viscosity: 5.6 $mm^2/s$ at 100° C.) | | Balance | Balance | Balance | Balance | Balance | Balance | Balance | Balance | Balance |
| Additive components | ZnDTP (wt % as P) | 0.14 | 0.14 | 0.14 | 0.14 | 0.08 | 0.08 | 0.14 | 0.14 | 0.08 |
| | MoDTC (wt % as Mo) | 0.07 | 0.07 | 0.07 | 0.07 | 0.07 | 0.07 | 0.04 | 0.04 | 0.04 |
| | MoDTP (wt % as Mo) | 0 | 0 | 0 | 0 | 0 | 0 | 0 | 0 | 0 |
| | $(CH_2)$ DTC (wt %) | 0 | 0 | 0 | 0 | 0 | 0 | 0 | 0 | 0 |
| | Other additives*1 | Added | Added | Added | Added | Added | Added | Added | Added | Added |
| Content of soot in the oil (wt %) | | 0 | 2.0 | 3.0 | 5.0 | 2.0 | 5.0 | 2.0 | 5.0 | 2.0 |
| SRV friction/wear test results, Wear Scar Diameter of wear-caused indentation (mm)*2 | | 0.144 | 0.200 | 0.220 | 0.226 | 0.207 | 0.233 | 0.206 | 0.233 | 0.209 |
| Motoring VTW test results, Demerit rating*3 | | 20.4 | • | 34.3 | • | • | • | • | • | • |

*1Other additives were a metallic detergent, ashless dispersant, viscosity index improver, pour point depressant, antioxidant and antifoaming agent.
*2The SRV friction/wear test conditions were temperature: 80° C., test period: 30 min, load: 150 N, amplitude: 1.5 mm and frequency: 50 Hz.
*3The motoring VTW test conditions were oil temperature 80° C., engine speed: 1,000 rpm, test period: 100 h. The wear was rated by demerit rating of 0 to 100, the best rating being 0.

Comparative Examples 1 to 17

The lubricant oil compositions were prepared by incorporating each lubricant base oil shown in Table 2 or 3 with additives and soot also shown in Table 2 or 3. Comparative Examples 1 to 4 and 8 to 10 used no sulfurized oxymolybdenum dithiocarbamate, Comparative Examples 5 to 7 did use the sulfurized oxymolybdenum dithiocarbamate but in

TABLE 2

| | | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|---|
| Base oil: Mineral oil (viscosity: 5.6 $mm^2/s$ at 100° C.) | | Balance | Balance | Balance | Balance | Balance | Balance | Balance | Balance | Balance |
| Additive components | ZnDTP (wt % as P) | 0.14 | 0.14 | 0.14 | 0.14 | 0.14 | 0.14 | 0.14 | 0.18 | 0.18 |
| | MoDTC (wt % as Mo) | 0 | 0 | 0 | 0 | 0.01 | 0.01 | 0.01 | 0 | 0 |
| | MoDTP (wt % as Mo) | 0 | 0 | 0 | 0 | 0 | 0 | 0 | 0 | 0 |
| | $(CH_2)$ DTC (wt %) | 0 | 0 | 0 | 0 | 0 | 0 | 0 | 0 | 0 |
| | Other additives*1 | Added | Added | Added | Added | Added | Added | Added | Added | Added |
| Content of soot in the oil (wt %) | | 0 | 2.0 | 3.0 | 5.0 | 0 | 2.0 | 5.0 | 0 | 2.0 |
| SRV friction/wear test results, Wear Scar Diameter of wear-caused indentation (mm)*2 | | 0.161 | 0.262 | 0.267 | 0.278 | 0.168 | 0.246 | 0.258 | 0.151 | 0.259 |
| Motoring VTW test results, Demerit rating*3 | | • | • | 80.6 | • | • | • | • | • | • |

*1Other additives were a metallic detergent, ashless dispersant, viscosity index improver, pour point depressant, antioxidant and antifoaming agent.
*2The SRV friction/wear test conditions were temperature: 80° C., test period: 30 min, load: 150 N, amplitude: 1.5 mm and frequency: 50 Hz.
*3The motoring VTW test conditions were oil temperature 80° C., engine speed: 1,000 rpm, test period: 100 h. The wear was rated by demerit rating of 0 to 100, the best rating being 0.

an insufficient quantity, Comparative Examples 11 to 13 used methylene dithiocarbamate [$(CH_2)$DTC] in place of the sulfurized oxymolybdenum dithiocarbamate, Comparative 2. The results are given in Table 2 or 3.

TABLE 3

| | | Comparative Example 10 | Comparative Example 11 | Comparative Example 12 | Comparative Example 13 | Comparative Example 14 | Comparative Example 15 | Comparative Example 16 | Comparative Example 17 |
|---|---|---|---|---|---|---|---|---|---|
| Base oil: Mineral oil (viscosity: 5.6 $mm^2/s$ at 100° C.) | | Balance | Balance | Balance | Balance | Balance | Balance | Balance | Balance |
| Additive components | ZnDTP (wt % as P) | 0.18 | 0.14 | 0.14 | 0.14 | 0 | 0 | 0 | 0.14 |
| | MoDTC (wt % as Mo) | 0 | 0 | 0 | 0 | 0.07 | 0.07 | 0.07 | 0 |
| | MoDTP (wt % as Mo) | 0 | 0 | 0 | 0 | 0 | 0 | 0 | 0.02 |
| | $(CH_2)$ DTC (wt %) | 0 | 0.3 | 0.3 | 0.3 | 0 | 0 | 0 | 0 |
| | Other additives*1 | Added | Added | Added | Added | Added | Added | Added | Added |
| Content of soot in the oil (wt %) | | 5.0 | 0 | 2.0 | 5.0 | 0 | 2.0 | 5.0 | 2.0 |
| SRV friction/wear test results, Wear Scar Diameter of wear-caused indentation (mm)*2 | | 0.296 | 0.181 | 0.264 | 0.288 | 0.170 | 0.277 | 0.372 | 0.249 |
| Motoring VTW test results, Demerit rating*3 | | • | • | | • | • | • | • | • |

*1Other additives were a metallic detergent, ashless dispersant, viscosity index improver, pour point depressant, antioxidant and antifoaming agent.
*2The SRV friction/wear test conditions were temperature: 80° C., test period: 30 min, load: 150 N, amplitude: 1.5 mm and frequency: 50 Hz.
*3The motoring VTW test conditions were oil temperature: 80° C., engine speed: 1,000 rpm, test period: 100 h. The wear was rated by demerit rating of 0 to 100, the best rating being 0.

It is apparent, from the results of Examples and Comparative Examples, that the lubricant oil composition of the present invention, comprising a base oil incorporated with specific quantities of the (A) sulfurized oxymolybdenum dithiocarbamate and (B) zinc dialkyl dithiophosphate as the essential components, shows excellent effect of preventing wear of sliding members, e.g., valve train, under the lubricating condition with soot in the oil. It is particularly noted that the lubricant oil composition incorporated with both the sulfurized oxymolybdenum dithiocarbamate and zinc dialkyl dithiophosphate shows clearly higher effect of preventing wear than the one prepared by Comparative Example which used methylene dithiocarbamate or sulfurized oxymolybdenum dialkyl dithiocarbamate in place of the sulfurized oxymolybdenum dithiocarbamate.

It is apparent that a lubricant oil composition may not fully exhibit the effect of preventing wear under the lubricating condition with soot in the oil, and may not have sufficient quality as a lubricant oil for diesel engines, in particular those equipped with an EGR system, unless its base oil is incorporated with specific quantities of the (A) sulfurized oxymolybdenum dithiocarbamate and (B) zinc dialkyl dithiophosphate as the essential components for the present invention. In other words, it is apparent that a lubricant oil composition for diesel engines which shows excellent effect of preventing wear of sliding members, e.g., valve train, under the lubricating condition with oil-insoluble soot in the oil can be provided by incorporating its base oil with specific quantities of the (A) sulfurized oxymolybdenum dithiocarbamate and (B) zinc dialkyl dithiophosphate.

What is claimed is:

1. A method for reducing soot induced wear of a diesel engine lubricated with a lubricating oil wherein the oil becomes contaminated with from about 0.2 wt % to 10 wt % soot, the method comprising lubricating the diesel engine with a lubricating oil comprising a base oil composed of a mineral and/or synthetic oil incorporated with at least two types of additives (A) and (B):

(A) sulfurized oxymolybdenum dithiocarbamate (MoDTC) having the formula:

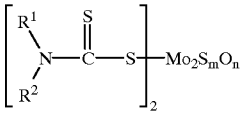

wherein $R^1$ and $R^2$ are the same or different hydrocarbon groups of from 4 to 18 carbon atoms, m and n are each positive integers and the sum of m and n equals 4, the MoDTC being present at 0.03 to 0.50 wt % Mo, based on the whole composition; and (B) zinc dialkyl dithiophosphate (ZDTP) having the formula

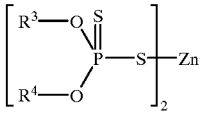

wherein $R^3$ and $R^4$ are the same or different primary or secondary alkyl groups of from 1 to 18 carbon atoms, the ZDTP being present at 0.04 to 5.0 wt % P, based on the whole composition.

2. The method of claim 1 wherein the MoDTC is present at 0.04 to 0.20 wt % as Mo.

3. The method of claim 1 wherein the ZDTP is present at 0.07 to 0.20 wt % as P.

* * * * *